US006205883B1

(12) United States Patent
Bortolon

(10) Patent No.: US 6,205,883 B1
(45) Date of Patent: Mar. 27, 2001

(54) ADJUSTABLE PEDAL-POCKETED GEARS

(75) Inventor: Christopher Bortolon, Clawson, MI (US)

(73) Assignee: Teleflex Incorporated, Plymouth Meeting, PA (US)

( * ) Notice: Subject to any disclaimer, the term of this patent is extended or adjusted under 35 U.S.C. 154(b) by 0 days.

(21) Appl. No.: 09/409,514

(22) Filed: Sep. 30, 1999

(51) Int. Cl.[7] ..... G05G 1/14
(52) U.S. Cl. ..... 74/512; 74/560; 74/606 R
(58) Field of Search ..... 74/512, 513, 560, 74/514, 425, 606 R

(56) References Cited

U.S. PATENT DOCUMENTS

| | | | | |
|---|---|---|---|---|
| 1,781,083 | * | 11/1930 | Schmick | 74/425 |
| 3,643,525 | | 2/1972 | Gibas | 74/512 |
| 4,023,433 | * | 5/1977 | Schutz | 74/425 |
| 4,989,474 | | 2/1991 | Cicotte et al. | 74/512 |
| 5,078,024 | | 1/1992 | Cicotte et al. | 74/512 |
| 5,460,061 | | 10/1995 | Redding et al. | 74/512 |
| 5,697,260 | | 12/1997 | Rixon et al. | 74/514 |
| 5,722,302 | | 3/1998 | Rixon et al. | 74/512 |
| 5,819,593 | | 10/1998 | Rixon et al. | 74/514 |

* cited by examiner

*Primary Examiner*—Mary Ann Green
(74) *Attorney, Agent, or Firm*—Howard & Howard

(57) ABSTRACT

Two embodiments (10 and 110) of an adjustable pedal assembly are characterized by a first component (34 or 134) surrounding one half of a worm gear (30 or 130) and a first length of the worm (32 or 132) and a second component (36 or 136) surrounding the other one half of the worm gear (30 or 130) and a second length of the worm (32 or 132). A support (12 or 112) includes a pocket holding the first (34 or 134) and second (36 or 136) components in abutting relationship with one another. In the embodiment of FIGS. 1–3, the pocket (46) is defined by and within the support (12) and the support (12) includes flexible tabs (48) for snapping the first (34 or 134) and second (36 or 136) components into the pocket (46). In the embodiment of FIG. 4, the pocket (146) is defined by a box-like clamp (146) extending about the first (38 or 138) and second (42 or 142) covers and attached to the support (112) by a fastener (160).

20 Claims, 3 Drawing Sheets

20
12
34
40
32
48
44
28
38
36
42
26
52
30
50
14
28
15
54
56
24
16
16
22

ADJUSTABLE PEDAL-POCKETED GEARS

BACKGROUND OF THE INVENTION

1. Field of the Invention

The subject invention relates an adjustable pedal assembly for use in an automotive vehicle to adjust the position of the pad supported by a pedal lever between various operational positions to accommodate various operator positions.

2. Description of the Prior Art

Such adjustable pedal assemblies typically include a support for attachment to a vehicle, a pedal lever having a distal end, and a pad attached to the distal end of the pedal lever for receiving a force from a vehicle operator for moving the pedal lever from an operational position. A mechanism interconnects the pedal lever and the support for providing an output to a control element in response to movement of the pedal lever from the operational position and for adjusting the pad between various operational positions to accommodate various operator positions. Frequently, a plurality of gears are driven by an electric motor to adjust the pad between various operational positions. These gears are pre-assembled in a gear box which, in turn, must be assembled to the remaining adjustable pedal components. Examples of such assemblies are disclosed in U.S. Pat. Nos. 3,643,525; 4,875,385; 4,989,474; 5,078,024; 5,460,061; 5,697,260; 5,722,302 and 5,819,593. However, there is always a need to reduce manufacturing and assembly time and expense.

SUMMARY OF THE INVENTION AND ADVANTAGES

The subject invention provides an improved adjustable pedal assembly comprising a support for attachment to a vehicle, a pedal lever having a distal end, and a pad attached to the distal end of the pedal lever for receiving a force from a vehicle operator for moving the pedal lever from an operational position. A mechanism interconnects the pedal lever and the support for providing an output to a control element in response to movement of the pedal lever from the operational position and for adjusting the pad between various operational positions to accommodate various operator positions and a plurality of gears adjust the pad between various operational positions. The assembly is characterized by a plurality of housing components coacting to surround and support the gears.

Accordingly, the subject invention provides an adjustable pedal assembly wherein the manufacture of the gear train and the other components is greatly simplified as is the assembly of such components.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
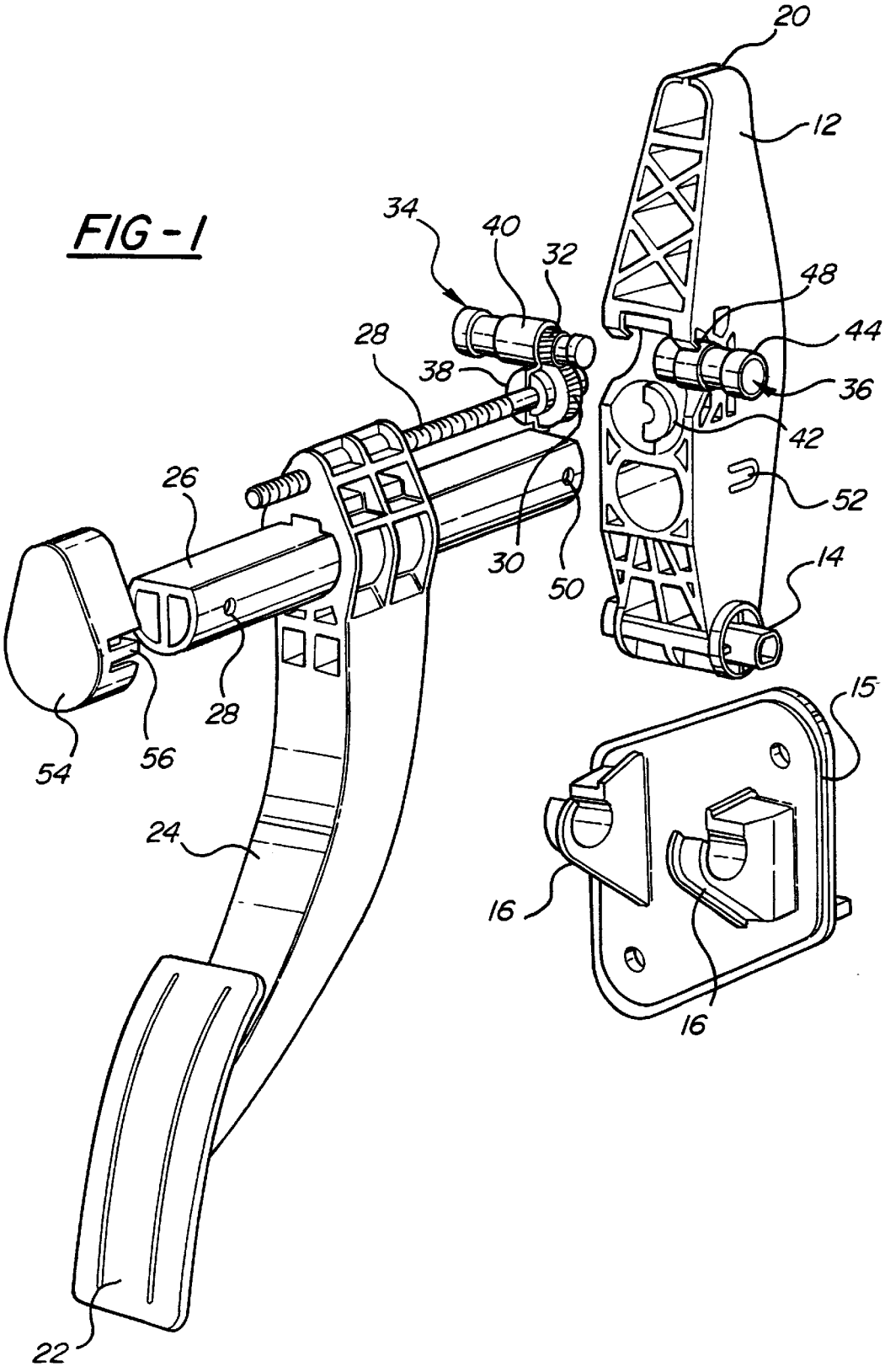
FIG. 1 is a perspective view of a first embodiment of the subject invention.
Figure 4:
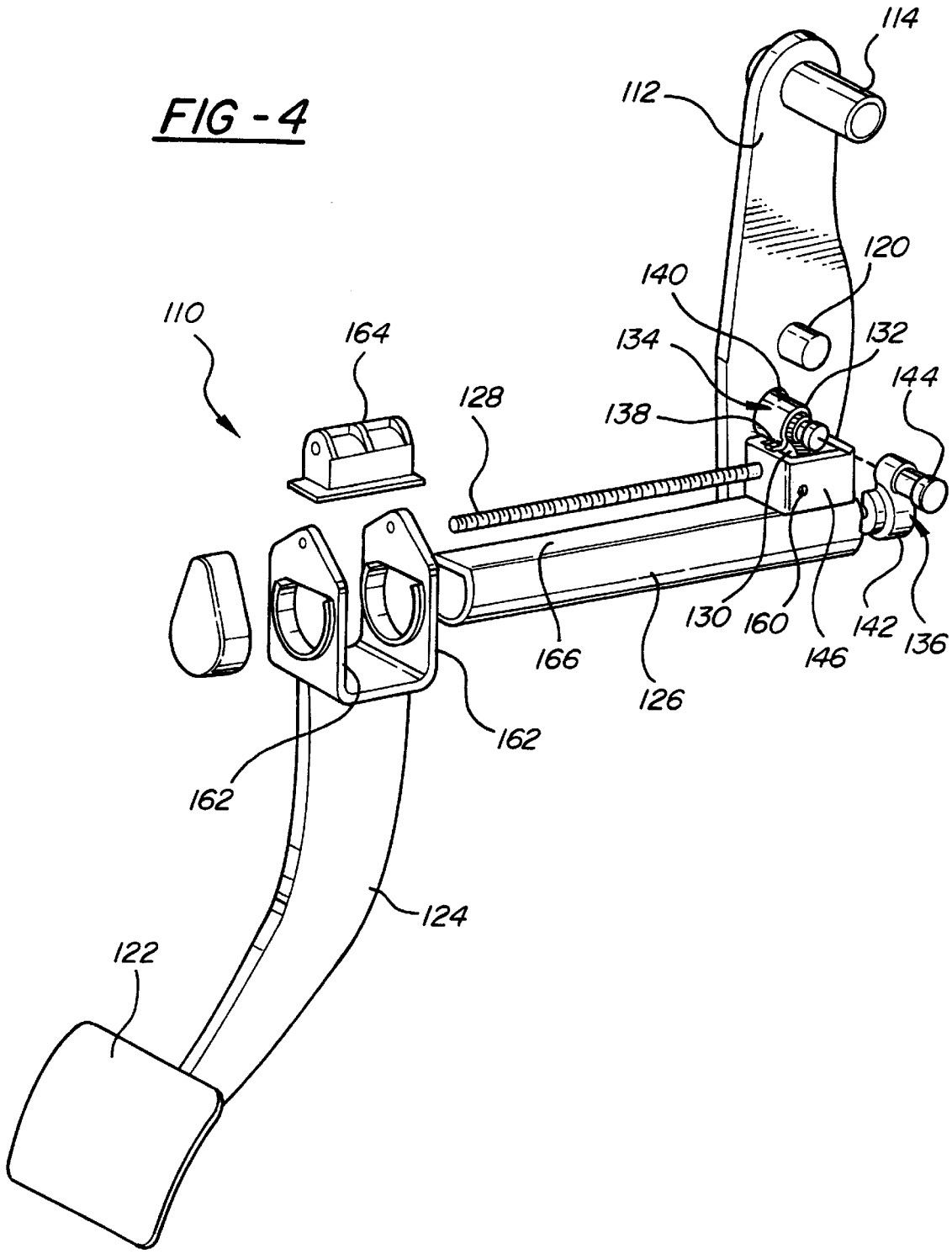
FIG. 4 is a perspective view of a second embodiment of the subject invention.

Referring to the Figures, wherein numerals differing by one hundred indicate like or corresponding parts throughout the several embodiments, an adjustable pedal assembly is generally shown at 10 and 110 in FIGS. 1 and 4 respectively.

Figure 3:
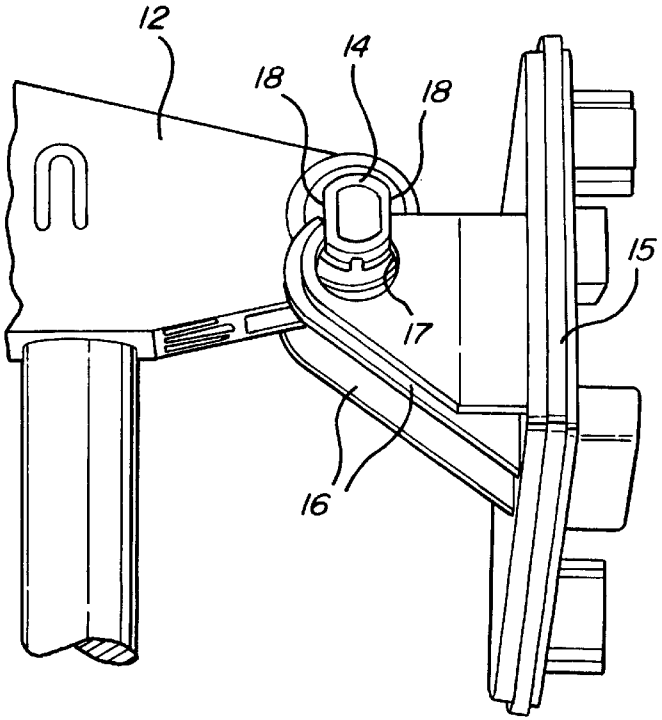
FIG. 3 is a perspective view of the embodiment of FIG. 1 during assembly.

A support 12 and 112 is adapted for pivotal connection to the vehicle by a rotatable pin or shaft 14 or 114. The embodiment of FIGS. 1 through 3 includes a bracket 15 for attachment to the vehicle and provides an interference connection between the support 12 and the bracket 15 for assembling the support 12 to the bracket 15 in an assembly alignment condition of the support 12 relative to the bracket 15 and for retaining the support 12 connected to the bracket 15 in an interference condition. More specifically, and as illustrated in FIG. 3, the bracket 15 presents arms 16 having C-shaped openings 17 for receiving the shafts 14 having flats 18 on opposite sides when the flats 18 are aligned with the slots of the C-shaped openings 17, i.e., the aligned condition, with the slots being more narrow than the diameters of the shafts 14 to retain the shafts 14 in the C-shaped openings 17 during operation, i.e., the assembly alignment condition.

Each support 12 and 112 includes a connector 20 or 120 for connection to a control element, such as a throttle or a brake rod or cable.

A pad 22 or 122 is attached to a distal end of a pedal lever 24 or 124 for receiving a force from a vehicle operator for moving the pedal lever 24 or 124 from an operational position by rotation about the axes of the shafts 14 and 114.

A mechanism interconnects the pedal lever 24 or 124 and the support 12 or 112 for providing an output to a control element via the connector 20 or 120 in response to movement of the pedal lever 24 or 124 from the operational position and for adjusting the pad 22 or 122 between various operational positions to accommodate various operator positions. More specifically, the mechanism includes a guide rod 26 or 126 attached to the support 12 or 112 and extending to a distal end. The pedal lever 24 or 124 is slidably supported on the guide rod 26 or 126 at a first end and depends downwardly to the distal end of the pedal lever 24 or 124. A plurality of gears adjust the pad 22 or 122 between various operational positions gears and include a worm 32 or 132 gear 30 or 130 and a worm 32 or 132 in meshing engagement with one another. A screw 28 or 128 is connected to and rotated by the worm gear 30 or 130 and extends to a distal end. The screw 28 or 128 is in threaded engagement with the pedal lever 24 or 124 for adjusting the pedal lever 24 or 124 along the guide rod 26 or 126 between the various operational positions.

Each assembly 10 or 110 is characterized by a plurality of housing components coacting to surround and support the gears 30 or 130 and 32 or 132. In this case, a first component, generally indicated at 34 or 134, surrounds one half of the worm gear 30 or 130 and a first length of the worm 32 or 132 and a second component 36 or 136 surrounds the other one half of the worm gear 30 or 130 and a second length of the worm 32 or 132. The first component 34 or 134 includes a first semi-circular cover 38 or 138 surrounding one diametrical half of the worm gear 30 or 130 and a first tube 40 or 140 integral with the first cover 38 or 138 and surrounding the first length of the worm 32 or 132. The second component 36 or 136 includes a second semi-circular cover 42 or 142 surrounding the other one diametrical half of the worm gear 30 or 130 to abut the first cover 38 or 138 and a second tube 44 or 144 integral with the second cover 42 or 142 and surrounding the second length of the worm 32 or 132 to abut the first tube 40 or 140. The first 40 or 140 and second 44 or 144 tubes abut one another in the same plane as the first 38 or 138 and second 42 or 142 covers abut one another. The first component 34 or 134 and the second component 36 or 136 are made of and consist of an organic polymeric material, i.e., plastic.

The support 12 or 112 includes a pocket holding the first 34 or 134 and second 36 or 136 components in position surrounding the gears 30 or 130 and 32 or 132. The pocket 46 or 146 engages the first 38 or 138 and second 42 or 142 covers to hold the first 34 or 134 and second 36 or 136 components in abutting relationship with one another.

Figure 2:
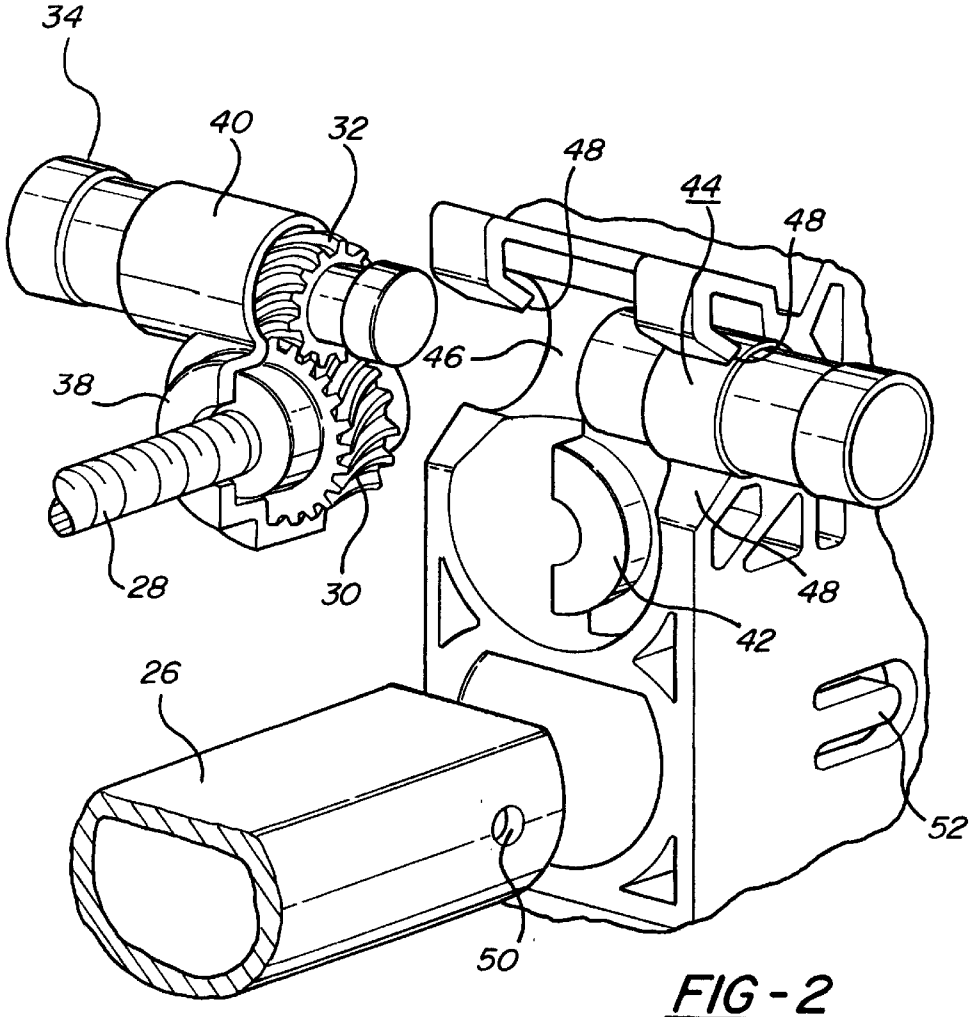
FIG. 2 is an exploded partial view of the central section of FIG. 1.

Turning first to the embodiment of FIGS. 1–3, the pocket 46 is defined by and within the support 12 and the support 12 includes flexible tabs 48 for snapping the first 34 or 134 and second 36 or 136 components into the pocket 46. The tabs 48 flex as the tubes are pushed into the pocket 46 and snap back to engage the first 40 or 140 and second 44 or 144 tubes to retain the first 34 or 134 and second 36 or 136 components in the pocket 46. The support 12 also consists of an organic polymeric material.

The support 12 includes a rod cavity into which the guide rod 26 is inserted and disposed. The guide rod 26 is hollow and includes a female retainer in the form of a pair of holes 50 and the support 12 has a flexible male retainer in the form of a pair of tongues 52 with projections for snapping into the holes 50 as the guide rod 26 is inserted into the rod cavity for retaining the guide rod 26 in the rod cavity and attached to the support 12.

A cap 54 is snapped into mechanical interlocking engagement with the distal end of the guide rod 26 and engages the distal end of the screw 28. The cap 54 also has a pair of tongues 56 with projections for snapping into holes 58 in the guide rod 26.

The bracket 15, the pedal lever 24 and the cap 54 consist of an organic polymeric material or plastic to facilitate the snapping together of the assembly.

Turning to the embodiment of FIG. 4, the pocket 146 is defined by a box-like clamp extending about the first 38 or 138 and second 42 or 142 covers and attached to the support 112. The clamp 146 is defined by two C-shaped halves connected by a living hinge and held together by a fastener 160 which also threasdedly engages the support 112. The support 112 is defined by a plate attached to one side of the guide rod 126 and the clamp 146 is disposed above the guide rod 126 and held in engagement with the plate by the fastener 160.

The pedal lever 124 includes a U-shaped mount having spaced legs 162 with holes therein. The guide rod 126 extends through the holes in the legs 162. A nut member 164 threadedly engages the screw 128 and extends between the legs 162. The generally circular guide rod 126 has a flat 166 on the top thereof and the nut member 164 engages the flat 166. The nut member 164 also consists of organic polymeric or plastic material.

Plastic bushings 168 are disposed in the holes of the legs 162 and are in sliding engagement with the guide rod 126 whereby the bushings 168 and the nut member 164 coact to slidably support 112 the legs 162 of the pedal lever 124 on the guide rod 126.

A metal cap 154 is attached to the distal end of the guide rod 126 by a set screw and engages the distal end of the screw 128.

The invention has been described in an illustrative manner, and it is to be understood that the terminology which has been used is intended to be in the nature of words of description rather than of limitation.

Obviously, many modifications and variations of the present invention are possible in light of the above teachings and the invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth an old and well known combination in which the invention resides and these antecedent recitations should be interpreted to cover any combination in which the inventive novelty has utility. In addition, the reference numerals are merely for convenience and are not to be in any way to be read as limiting.

What is claimed is:

1. An adjustable pedal assembly comprising;

a support (12 or 112) for attachment to a vehicle, a pedal lever (24 or 124) having a distal end, a pad (22 or 122) attached to said distal end of said pedal lever (24 or 124) for receiving a force from a vehicle operator for moving said pedal lever (24 or 124) from an operational position, a mechanism interconnecting said pedal lever (24 or 124) and said support (12 or 112) for providing an output to a control element in response to movement of said pedal lever (24 or 124) from said operational position and for adjusting said pad (22 or 122) between various operational positions to accommodate various operator positions, a plurality of gears for adjusting said pad (22 or 122) between various operational positions, a plurality (34 or 134 and 36 or 136) of housing components coacting to surround and support said gears, said gears including a worm gear (30 or 130) and a worm (32 or 132) in meshing engagement with one another, said plurality of housing components including a first component (34 or 134) surrounding one half of said worm gear (30 or 130) and a first length of said worm (32 or 132) and a second component (36 or 136) surrounding the other one half of said worm gear (30 or 130) and a second length of said worm (32 or 132), said support (12 or 112) including a pocket (46 or 146) holding said first (34 or 134) and second (36 or 136) components in position surrounding said gears, said first component (34 or 134) including a first semi-circular cover (38 or 138) surrounding one diametrical half of said worm gear (30 or 130) and an first tube (40 or 140) integral with said first cover (38 or 138) and surrounding said first length of said worm (32 or 132), and said second component (36 or 136) including a second semi-circular cover (42 or 142) surrounding the other one diametrical half of said worm gear (30 or 130) to abut said first cove (38 or 138) and a second tube (44 or 144) integral with said second cover (42 or 142) and surrounding said second length of said worm (32 or 132) to abut said first tube (40 or 140).

2. An assembly as set forth in claim 1 wherein said first (40 or 140) and second (44 or 144) tubes abut one another in the same plane as said first (38 or 138) and second (42 or 142) covers abut one another.

3. An assembly as set forth in claim 2 wherein said pocket (46 or 146) engages said first (38 or 138) and second (42 or 142) covers to hold said first (34 or 134) and second (36 or 136) components in abutting relationship with one another.

4. An assembly as set forth in claim 3 wherein said support (12 or 112) is adapted for pivotal connection to the vehicle and includes a connector for connection to a control element.

5. An assembly as set forth in claim 4 wherein said mechanism includes a guide rod (26 or 126) attached to said support (12 or 112) and extending to a distal end, said pedal lever (24 or 124) slidably supported on said guide rod (26 or 126) at a first end and depending to said distal end, a screw (28 or 128) rotated by said worm gear (30 or 130) and extending to a distal end, said screw (28 or 128) being in threaded engagement with said pedal lever (24 or 124) for adjusting said pedal lever (24 or 124) along said guide rod (26 or 126) between said various operational positions.

6. An assembly as set forth in claim 5 wherein said screw (28 or 128) is disposed externally to and in spaced parallel relationship with said guide rod (26 or 126).

7. An assembly as set forth in claim 5 wherein said pocket (46) is defined by said support (12) and said support (12) includes flexible tabs (48) for snapping said first (34 or 134) and second (36 or 136) components into said pocket (46).

8. An assembly as set forth in claim 7 wherein said tabs (48) engage said first (40 or 140) and second (44 or 144) tubes.

9. An assembly as set forth in claim 8 wherein said support (12) consists of an organic polymeric material and includes a rod cavity, said guide rod (26) disposed in said rod cavity, said guide rod (26) including a female retainer and said support (12) having a flexible male retainer for snapping into said female retainer as said guide rod (26) is inserted into said rod cavity for retaining said guide rod (26) in said rod cavity and attached to said support (12).

10. An assembly as set forth in claim 9 including a bracket (15) for attachment to the vehicle, an interference connection between said support (12) and said bracket (15) for assembling said support (12) to said bracket (15) in an assembly alignment condition of said support (12) relative to said bracket (15) and for retaining said support (12) connected to said bracket (15) in an interference condition.

11. An assembly as set forth in claim 10 including a cap snapped into mechanical interlocking engagement with said distal end of said guide rod (26) and engaging said distal end of said screw (28).

12. An assembly as set forth in claim 11 wherein said bracket (15), said pedal lever (24) and said cap also consist of an organic polymeric material.

13. An assembly as set forth in claim 5 wherein said pocket (146) is defined by a clamp extending about said first (38 or 138) and second (42 or 142) covers and attached to said support (112).

14. An assembly as set forth in claim 13 wherein said support (112) is defined by a plate attached to one side of said guide rod (126) and said clamp is disposed above said guide rod (126) and in engagement with said plate.

15. An assembly as set forth in claim 14 wherein said pedal lever (124) includes a U-shaped mount having spaced legs with holes therein, said guide rod (126) extending through said holes in said legs, a nut member (164) threadedly engaging said screw (128) and extending between said legs.

16. An assembly as set forth in claim 15 wherein said guide rod (126) has a flat on the top thereof and said nut member (164) engages said flat.

17. An assembly as set forth in claim 16 wherein said nut member (164) consists of organic polymeric material.

18. An assembly as set forth in claim 17 including bushings in said holes and in sliding engagement with said guide rod (126) whereby said bushings and said nut member (164) coact to slidably support (112) said legs of said pedal lever (124) on said guide rod (126).

19. An assembly as set forth in claim 18 including a cap engaging said distal end of said guide rod (126) and said distal end of said screw (128).

20. An adjustable pedal assembly comprising;

a support (12 or 112) for attachment to a vehicle, a pedal lever (24 or 124) having a distal end, a pad (22 or 122) attached to said distal end of said pedal lever (24 or 124) for receiving a force from a vehicle operator for moving said pedal lever (24 or 124) from an operational position, a mechanism interconnecting said pedal lever (24 or 124) and said support (12 or 112) for providing an output to a control element in response to movement of said pedal lever (24 or 124) from said operational position and for adjusting said pad (22 or 122) between various operational positions to accommodate various operator positions, a plurality of gears for adjusting said pad (22 or 122) between various operational positions, a plurality (34 or 134 and 36 or 136) of housing components coacting to surround and support said gears, said support (12 or 112) including a pocket (46 or 146) holding said plurality of housing components (34 or 134 and 36 or 136) in position surrounding said gears, and flexible tabs (48) extending from said support (12 or 112) for snapping said housing components (34 or 134 and 36 or 136) into said pocket.

* * * * *